US012103744B2

(12) United States Patent
Förstmann

(10) Patent No.: US 12,103,744 B2
(45) Date of Patent: Oct. 1, 2024

(54) PACKET FOR CIGARETTE INDUSTRY PRODUCTS AND METHOD AND DEVICE FOR PRODUCING THE SAME

(71) Applicant: Focke & Co. (Gmbh & Co. KG), Verden (DE)

(72) Inventor: Dirk Förstmann, Verden (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 276 days.

(21) Appl. No.: 17/626,796

(22) PCT Filed: Jul. 15, 2020

(86) PCT No.: PCT/EP2020/070049
§ 371 (c)(1),
(2) Date: Jan. 12, 2022

(87) PCT Pub. No.: WO2021/013658
PCT Pub. Date: Jan. 28, 2021

(65) Prior Publication Data

US 2022/0315274 A1 Oct. 6, 2022

(30) Foreign Application Priority Data

Jul. 19, 2019 (DE) ..... 102019119609.4

(51) Int. Cl.
*B65D 5/489* (2006.01)
*B65B 19/22* (2006.01)
(Continued)

(52) U.S. Cl.
CPC ..... *B65D 5/4802* (2013.01); *B65B 19/223* (2013.01); *B65B 61/207* (2013.01); *B65D 85/1036* (2013.01); *B65D 85/1081* (2013.01)

(58) Field of Classification Search
CPC ..... B65D 5/4802; B65D 85/1036; B65B 19/223; B65B 61/207
See application file for complete search history.

(56) References Cited

U.S. PATENT DOCUMENTS 2,329,866 A 9/1943 Sickels
2,688,432 A 9/1954 Frankenstein
(Continued)

FOREIGN PATENT DOCUMENTS

DE 102014009283 A1 10/2015
DE 102015014148 A1 5/2016
(Continued)

OTHER PUBLICATIONS

WIPO, International Search Report (on parent application), Nov. 12, 2020.
(Continued)

*Primary Examiner* — Robert F Long
*Assistant Examiner* — Xavier A Madison
(74) *Attorney, Agent, or Firm* — Laurence P. Colton; Smith Tempel Blaha LLC

(57) ABSTRACT

A packet for cigarette industry products, having a tray for receiving at least one group of products, and a device and a method for producing the same. The packet is characterized in that the tray is specified for receiving at least two groups of products, and in that at least one separator for delimiting two receptacle spaces for in each case at least one group of products is disposed in an interior of the tray, and in that the separator is formed from a wall of the tray.

20 Claims, 14 Drawing Sheets

(51) Int. Cl.
*B65B 61/20* (2006.01)
*B65D 85/10* (2006.01)

(56) References Cited

U.S. PATENT DOCUMENTS

| | | | | | |
|---|---|---|---|---|---|
| 4,154,390 | A * | 5/1979 | Focke | B65D 85/1018 | 206/256 |
| 4,204,630 | A * | 5/1980 | Focke | B65D 85/1045 | 229/87.13 |
| 4,932,534 | A * | 6/1990 | Focke | B65D 5/5495 | 229/120.09 |
| 2001/0007187 | A1 * | 7/2001 | Focke | B65B 19/223 | 53/461 |
| 2012/0241339 | A1 * | 9/2012 | Buse | B65B 19/226 | 206/268 |
| 2017/0107047 | A1 * | 4/2017 | Ruthemeier | B65B 19/025 | |
| 2019/0002187 | A1 | 1/2019 | Kahawaiolaa | | |

FOREIGN PATENT DOCUMENTS

| | | | |
|---|---|---|---|
| DE | 102015014182 | A1 | 5/2016 |
| DE | 102016007827 | A1 | 11/2017 |
| DE | 102016120506 | A1 | 3/2018 |
| EP | 0994029 | A1 | 4/2000 |
| GB | 493733 | A | 10/1938 |
| GB | 508536 | A | 6/1939 |
| GB | 2525599 | A | 11/2015 |
| WO | 2010026020 | A1 | 3/2010 |
| WO | 2016024239 | A1 | 2/2016 |
| WO | 2019186454 | A1 | 10/2019 |

OTHER PUBLICATIONS

Deutches Patent—Und Markenamt (German Patent and Trademark Office), Recherchebericht (search in a related application), Apr. 2, 2020.

* cited by examiner 10
12
13
15
17
18
19
20
21
22
23
24

PACKET FOR CIGARETTE INDUSTRY PRODUCTS AND METHOD AND DEVICE FOR PRODUCING THE SAME

CROSS REFERENCE TO RELATED APPLICATIONS

This patent application is the national phase of, and claims priority on and the benefit of, International Application No. PCT/EP2020/070049 having an international filing date of 15 Jul. 2020, which claims priority on and the benefit of German Patent Application No. 10 2019 119 609.1 having a filing date of 19 Jul. 2019.

BACKGROUND OF THE INVENTION

The invention relates to a packet for cigarette industry products, having a tray for receiving at least one group of products.

Furthermore, the invention relates to a method for producing packets for cigarette industry products, wherein a blank of the packaging material for a tray of the packet is introduced into a pocket of a folding turret, and thereafter a group of products is introduced into the partially folded blank, and the blank, while being transported onward on the folding turret, then is folded about the group of products.

Finally, the invention relates to a device for producing packets for cigarette industry products, wherein the device is specified for receiving a blank of packaging material for a tray of the packet in a pocket of a folding turret, and for thereafter introducing a group of products into the partially folded blank, and for then folding the blank, while being transported onward on the folding turret, about the group of products.

BRIEF SUMMARY OF THE INVENTION

The invention pertains to the production of packets for two or more groups of products. The invention is based on the object of refining the packaging process, or a corresponding device, respectively, in particular with a view to separating the two groups of products in a manner easy to establish in terms of a method. A correspondingly suitable packet is also to be made available.

A device according to the invention is a packet for cigarette industry products, having a tray for receiving at least one group of products, provided that the tray is specified for receiving at least two groups of products, and that at least one separator for delimiting two receptacle spaces is for in each case one group of products is disposed in an interior of the tray, and that the at least one separator is formed from a wall of the tray.

The solution has the particular advantage that separate elements for forming the separator can be dispensed with, as a result of which material can be saved and the production simplified because no additional elements have to be fed when producing the packet.

According to one preferred design embodiment of the invention, it can be provided that the at least one separator is a folding tab which is formed by a punched cut in the material of a wall of the tray and for delimiting the receptacle spaces is able to be moved into the interior of the tray by being pivoted in relation to the respective wall of the tray.

It can furthermore preferably be provided that the tray has two large-area, mutually opposite walls, specifically an (upright) front wall and a corresponding rear wall, and that the tray has two (upright) narrow side walls which are mutually opposite and in each case connect the front wall and the rear wall to one another, and that the tray preferably has a (lower) base wall which connects the front wall, the rear wall and the side walls to one another, and that the at least one separator is disposed in at least one of the large-area walls, in particular the front wall and/or the rear wall.

It can preferably also be provided that the at least one separator in the position thereof delimiting the receptacle spaces is secured on another wall, in particular the base wall, of the tray.

This can preferably take place in that the at least one separator in the position thereof that the delimits the receptacle spaces is able to be secured by engaging, preferably by way of a locking protrusion configured on the separator, in a clearance formed in the other wall, in particular the base wall, of the tray.

Alternatively or additionally, it can be provided that the at least one separator in the position thereof delimiting the receptacle spaces is able to be secured by a locking tab which is formed in the other wall, in particular the base wall, of the tray and supports the separator.

It can preferably be provided that also the locking tab is formed by a punched cut in the material of the other wall, in particular the base wall, of the tray, and by pivoting in relation to the base wall is able to be moved to a position preferably unilaterally supporting the at least one separator.

This has the advantage that there is also no separate blank required for this member.

It can preferably be provided that at least some groups of products, or the products, respectively, are disposed in the tray so as to bear directly on walls of the latter.

It can preferably be provided that the tray is a component part of a sealed pack, and conjointly with the groups of products is surrounded by a sealed casing of packaging material.

A method according to the invention is a method for producing packets for cigarette industry products, wherein a blank of packaging material for a tray of the packet is introduced into a pocket of a folding turret, and thereafter a group of products is introduced into the partially folded blank, and the blank, while being transported onward on the folding turret, then is folded about the group of products, wherein it is provided that the blank has at least one separator which serves for delimiting two receptacle spaces in the interior of the tray for in each case at least one group of products and is formed by part of a wall of the blank, and that the separator by a folding member is pivoted to a position delimiting the receptacle spaces, in particular before the groups of products are fed.

It can preferably be provided that at least one separator in the position thereof delimiting the receptacle spaces is secured by a locking tab of the blank, and that the locking tab by a folding member is moved to a position securing the separator.

It can preferably also be provided that the at least one separator and the locking tab by a common folding member are moved to the position delimiting the receptacle spaces, or the position securing the separator.

It can furthermore preferably be provided that first the separator and then the locking tab are folded, or that first the locking tab and then the separator are folded, in particular by the common folding member or separate folding members.

It can furthermore preferably be provided that the at least one separator and/or the locking tab are/is folded in the context of introducing the blank into the pocket, or that the at least one separator and/or the locking tab are/is folded while the blank later is being transported on the folding turret, in particular in a station for feeding the groups of products.

It can moreover preferably be provided that the at least one separator in the position delimiting the receptacle spaces is held by an aligning element until the (two) groups of products on both sides of the separator have been fed into the pocket and the blank situated in the latter.

It can preferably be provided that a rotating centering wheel serves as an aligning member for the at least one separator, wherein the centering wheel has two walls and as a result of a corresponding profile of the walls is specified for first aligning the separator between the walls during the rotation of the centering wheel, and for then holding said separator in the aligned position between the walls during the rotation of the centering wheel.

It can preferably be provided that a separator holder serves as the aligning member for the at least one separator, said separator holder by way of walls gripping the separator peripherally, in particular from above, and holding the latter while the groups of products are being fed, said separator holder being retracted from the separator after the groups of products have been fed.

A device according to the invention is a device for producing packets for cigarette industry products, wherein the device is specified for receiving a blank of packaging material for a tray of the packet in a pocket of a folding turret, and for thereafter introducing a group of products into the partially folded blank, and for then folding the blank, while being transported onward on the folding revolver, about the group of products, wherein it is provided that the blank has at least one separator which serves for delimiting two receptacle spaces in the interior of the tray for in each case at least one group of products and is formed by part of a wall of the blank, and that the device, by way of a folding member, is specified for pivoting the at least one separator to a position delimiting the receptacle spaces, in particular before the groups of products are fed.

It can preferably be provided that the at least one separator in the position thereof delimiting the receptacle spaces is secured by a locking tab of the blank, and that the device has a folding member for moving the locking tab to a position securing the separator.

It can preferably be provided that the at least one separator and the locking tab by a common folding member are able to be moved to the position delimiting the receptacle spaces, or to the position securing the separator, respectively.

It can preferably be provided that the device has an aligning member so as to hold the at least one separator in the position delimiting the receptacle spaces until the (two) groups of products on both sides of the separator have been fed into the pocket and the blank situated in the latter.

It can preferably be provided that a rotating centering wheel is provided as the aligning member for the at least one separator, wherein the centering wheel has two walls and as a result of a corresponding profile of the walls is specified for first aligning the separator between the walls during the rotation of the centering wheel, and for then holding said separator in the aligned position between the walls during the rotation of the centering wheel.

It can preferably be provided that the centering wheel has two substantially parallel walls, the separator being held therebetween, and that the centering wheel has an inlet region which for feeding the at least one separator between the walls widens in the shape of a funnel.

It can preferably be provided that a separator holder is provided as an aligning member for the at least one separator, said separator holder by way of walls being specified for gripping the separator peripherally, in particular from above, and for holding the latter while the groups of products are being fed, said separator holder being able to be retracted from the separator after the groups of products have been fed.

BRIEF DESCRIPTION OF THE DRAWINGS

Further advantageous details of the invention are to be found in the remaining part of the description and in the drawings.

Preferred exemplary embodiments of the invention will be explained hereunder by means of preferred exemplary embodiments and the drawings in which.

DETAILED DESCRIPTION OF PREFERRED EMBODIMENTS

Figure 1:
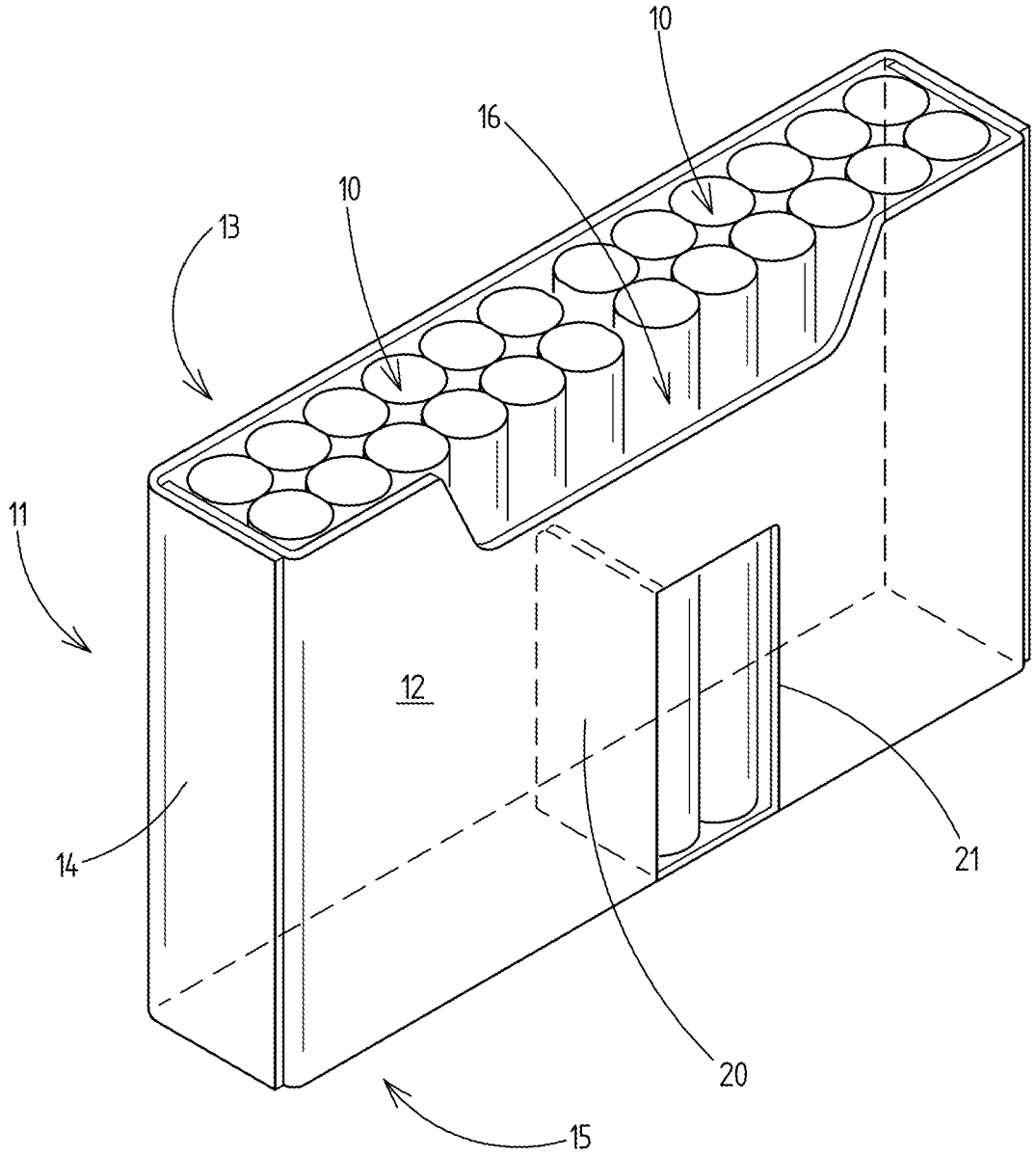
FIG. 1 shows a tray of a packet having two groups of products in a schematic, three-dimensional illustration.

The invention will be explained hereunder using an example of a packet for cigarette industry products. In the context of the application, this is understood to include tobacco products such as cigarettes, cigarillos and the like, or else novel tobacco products such as, for example, heat-not-burn products or liquid carriers for e-cigarettes.

In the present case, the products are specifically heat-not-burn products, thus so-called electronic cigarettes which are heated by an electronic apparatus that has a heating coil. E-cigarettes of this type have a shorter longitudinal extent than conventional cigarettes.

1. Configuration of the Packet:

The products are disposed in two groups 10 in one tray 11. Each group 10 possesses two rows of products having in each case six products per row. It is understood that the number of rows and the number of products per row may vary.

The tray 11 is configured in the shape of a cup, having a large-area front wall 12 and a corresponding rear wall 13 lying opposite the front wall 12, and two narrow side walls 14 that connect the front wall 12 to the rear wall 13. The tray 11 is open at the top. The tray 11 on the lower side is closed by a base wall 15. A peripheral clearance 16 which facilitates the retrieval of the products is formed on the upper periphery of the front wall 12. The products are disposed so as to stand in the tray 11 and preferably terminate flush with the upper side of the tray 11.

The tray 11 is formed from an integral blank 17 (FIG. 2) of packaging material, for example of cardboard. To this end, the walls of the blank 17 are folded along fold lines, and folding tabs are connected to one another by adhesive bonding. The narrow side walls 14 are thus formed by lateral tabs 18 that are connected to one another. The base wall 15 is connected to the narrow side walls 14 by base corner tabs 19.

A separator 20 serves for separating the two groups 10 in the tray 11. The separator 20 is part of the blank 17 and is not a separate element. In the present case, the separator 20 is formed by punching, or a punched cut 21, respectively, in the material of the front wall 12 and is able to be folded or pivoted, respectively, about a fold line to a position disposed between the two groups 10. The separator 20 therein is aligned transversely, in particular perpendicularly, to the front wall 12 of the tray 11. The separator 20 mutually delimits two receptacle spaces for in each case one group 10 of products that are formed in the interior of the tray 11.

The walls of the tray 11 in the present case, with the exception of the punched cut 21, are configured in a closed manner. In the context of the invention, this may differ, of course. It is conceivable for further openings to be provided, or for walls (such as the base wall 15, for example) to be dispensed with.

In order to achieve that the separator 20 remains in the position thereof separating the groups 10, or receptacle spaces, respectively, measures are provided so as to hold the separator 20 in this position.

Figures 2, 3, 4:
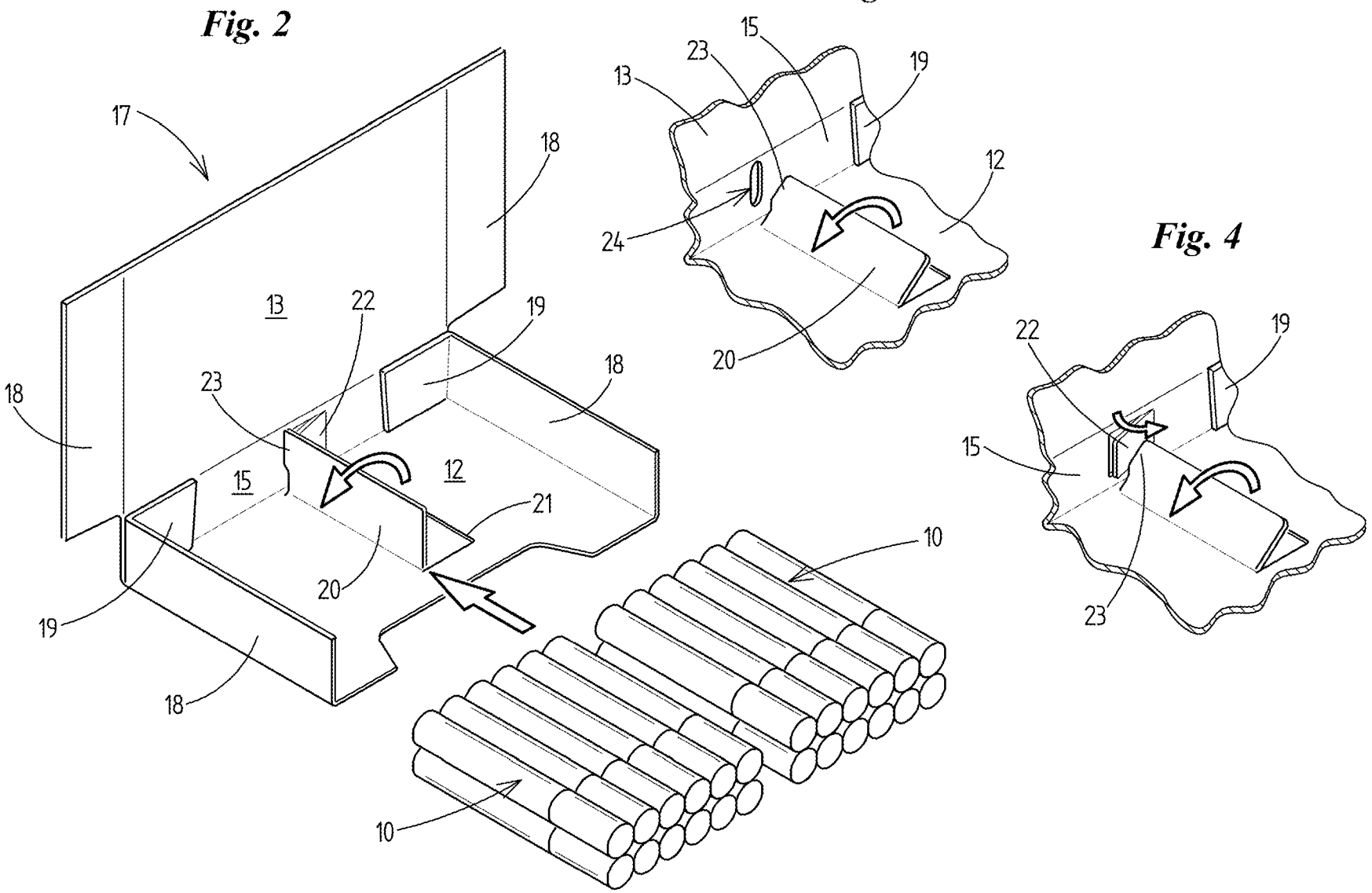
FIG. 2 shows a schematic, three-dimensional illustration of the feeding of two groups of products to a partially folded blank for a tray according to FIG. 1.
FIG. 3 shows a folding step when producing the tray.
FIG. 4 shows an alternative folding step when producing the tray.

FIGS. 2 and 4 show a solution having a locking tab 22 which is formed in the base wall 15 adjacent to the front wall 12, and like the separator 20 is folded or pivoted, respectively, about a fold line such that the erected separator 20 is laterally supported by the locking tab 22 so as to counteract any reverse pivoting or reverse folding, respectively, of the separator 20. Like the separator 20, the locking tab 22 is preferably formed or delimited, respectively, by a punched cut in the material of the base wall 15.

FIG. 3 shows an alternative solution in which the separator 20 has a locking protrusion 23 which in the position of the separator 20 delimiting the receptacle spaces engages in a clearance 24 in the adjacent base wall 15. The engagement preferably takes place in a form-fitting manner.

In the examples shown, the separator 20 does not extend beyond the entire height of the interior of the tray 11, or of the receptacle spaces, respectively. In other words, the separator 20 terminates at a spacing from the open upper side of the tray 11. In this way, the separator 20 is not prominently displayed to the consumers, at least not when using the packet for the first time, or prior to retrieving products, respectively. It is only once some products have been retrieved that the separator 20 can be readily seen by the consumer when looking into the interior of the tray 11.

In the present case, the separator 20, proceeding from the base wall 15, extends across approximately half the height of the tray 11, or in the region of the clearance 16 extends across approximately two thirds of the height of the front wall 12 in this region, respectively.

It is understood that the separator 20 does not mandatorily have to be configured on the front wall 12. Under the right circumstances, the rear wall 13 or one of the other side walls of the tray 11 in particular can likewise be considered for the disposal of the separator 20. The disposal of the locking tab 22, the locking protrusion 23 and the clearance 24 can also be adapted so as to correspond to the disposal of the separator 20.

The groups 10 of products bear directly on the tray 11, or on the separator 20 thereof, respectively, and conjointly with the tray 11 can be disposed in a casing so as to form a sealed pack having preferably sealed seams of the casing. The sealed pack thus achieved can be disposed in an outer pack, for example of the hinge-lid type.

Figure 5:
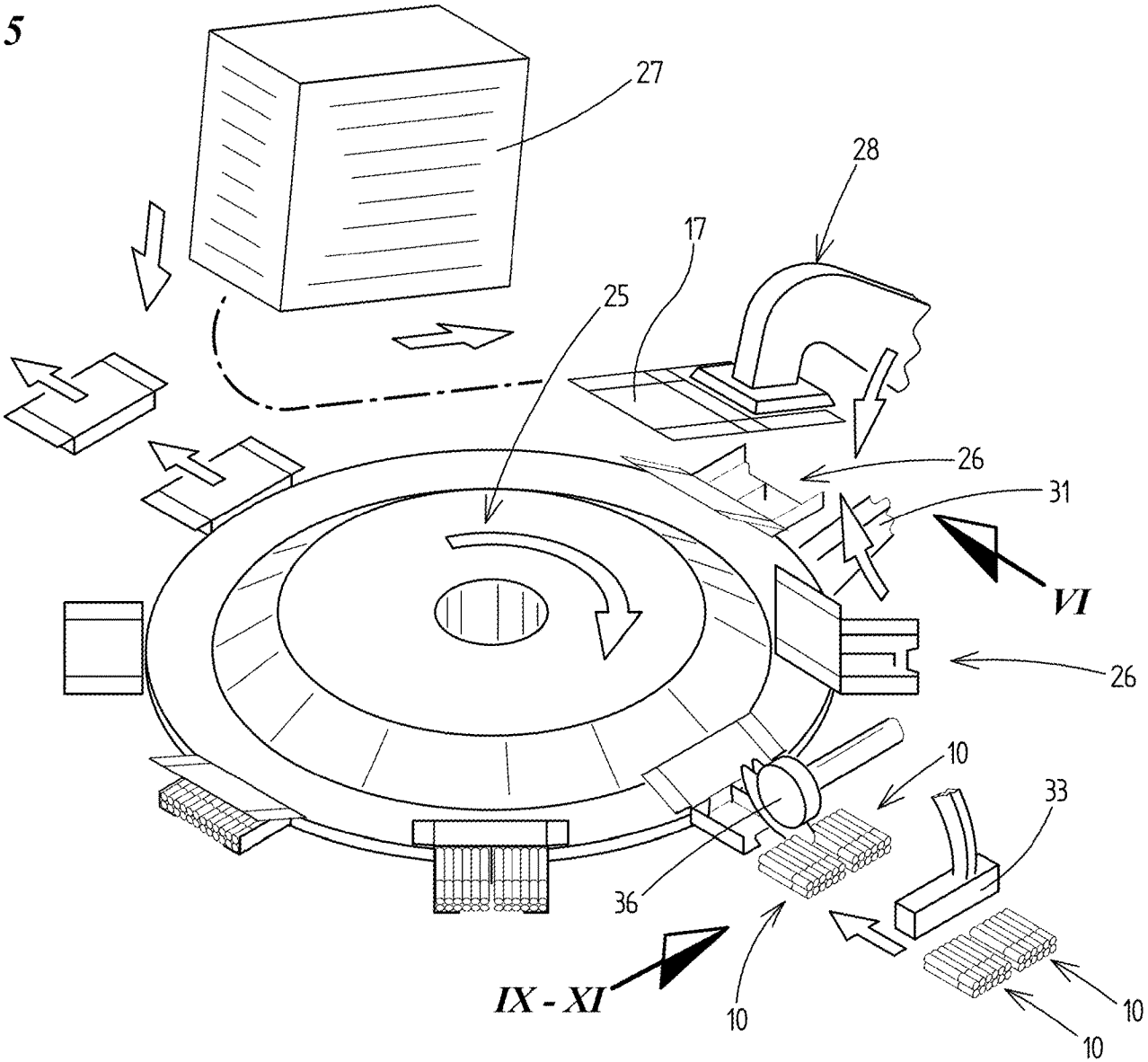
FIG. 5 shows part (a folding turret) of a device for filling a blank for the tray with groups of products.

2. Fundamental Configuration of the Device:

FIG. 5 shows a device for forming a tray 11 corresponding to the previously described configuration that encloses the groups 10. The focus here is a rotatably driven folding turret 25 which has pockets 26 for receiving a blank 17 for a tray 11 and for receiving groups 10 of products. The blanks 17 are substantially completely folded on the folding turret 25. It is only the connection between the lateral tabs 18 and the narrow side walls 14 that is performed after the ejection from the folding turret 25. Of course, deviations from this workflow sequence, which is customary for the applicant, are also conceivable.

Figure 6:
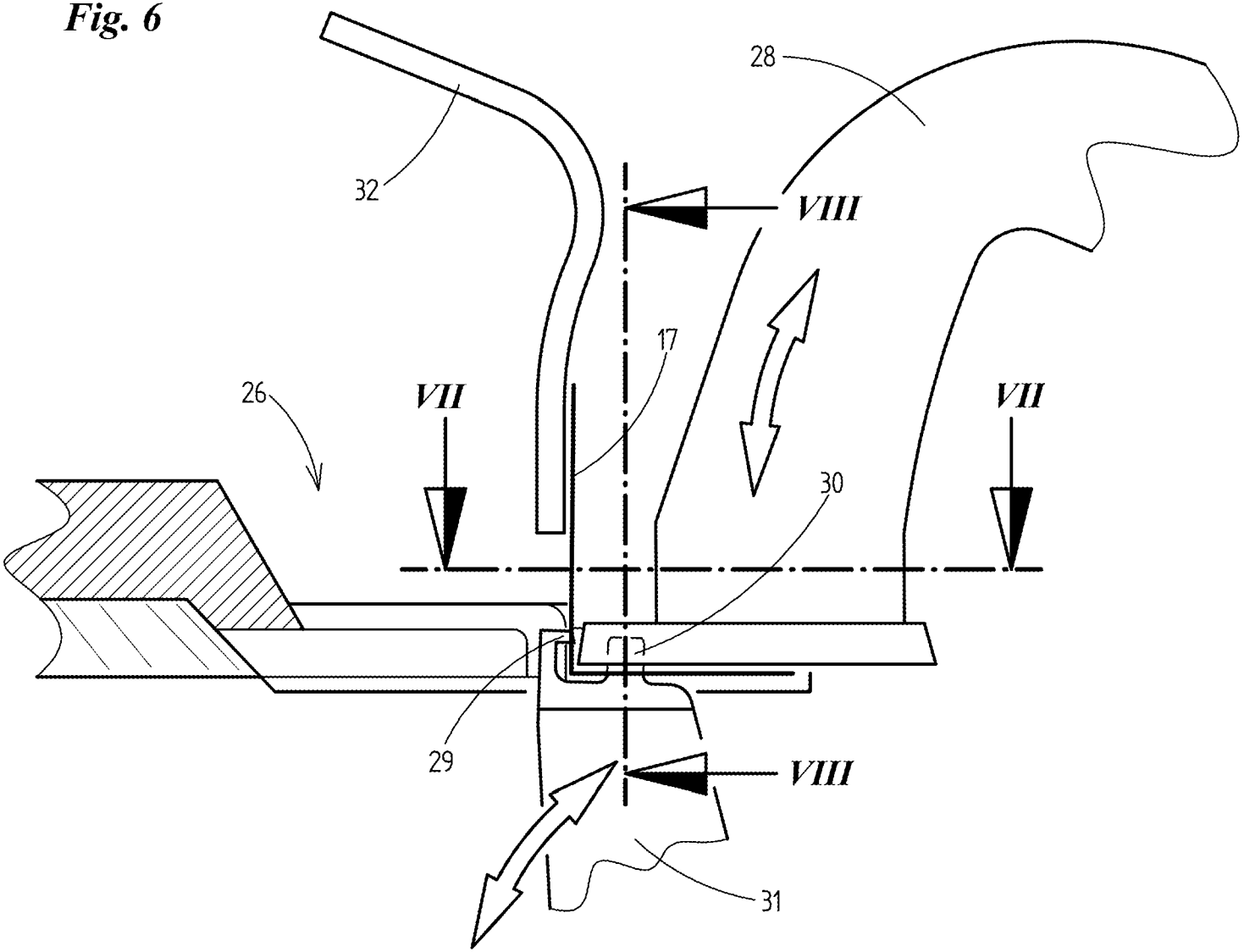
FIG. 6 shows a detail of the device, corresponding to the arrow VI in FIG. 5.

The blanks 17 are individually retrieved from the lower side of a magazine 27 and fed to an infeed station of the folding turret 25. Said blanks 17 at the latter are rammed into a pocket 26 by a ram 28 and herein partially folded. The front wall 12 of the tray 11 here lies flat on a base wall 15 of the pocket 26, and the lateral tabs 18 disposed on both sides of the front wall 12 of the blank 17 are erected. The base wall 15 and the rear wall 13 of the blank 17 are likewise erected in relation to the front wall 12 (FIG. 2). The rear wall 13 on the rear side bears on a guide rail 32 (FIG. 6).

2.1 Erecting the Separator (20) and the Locking Tab (22):

In the next step, the folding of the separator 20 and optionally of the locking tab 22, if present, takes place. This step is performed either conjointly with introducing the blank 17 into the pocket 26 in the infeed station, or in one of the downstream stations of the folding turret 25. The variant of folding according to FIGS. 2 and 4 in the infeed station is described hereunder:

Two folding members 29, 30 are provided in the region of the pocket 26 in the infeed station. The folding member 29 serves for folding the locking tab 22, whereas the folding member 30 serves for folding the separator 20. In the present case, the folding members 29, 30 are connected to one another by a common lever 31 such that said folding members 29, 30 can be conjointly moved or driven, respectively. Of course, a separate configuration of the folding members 29, 30 is also possible.

Figure 7:
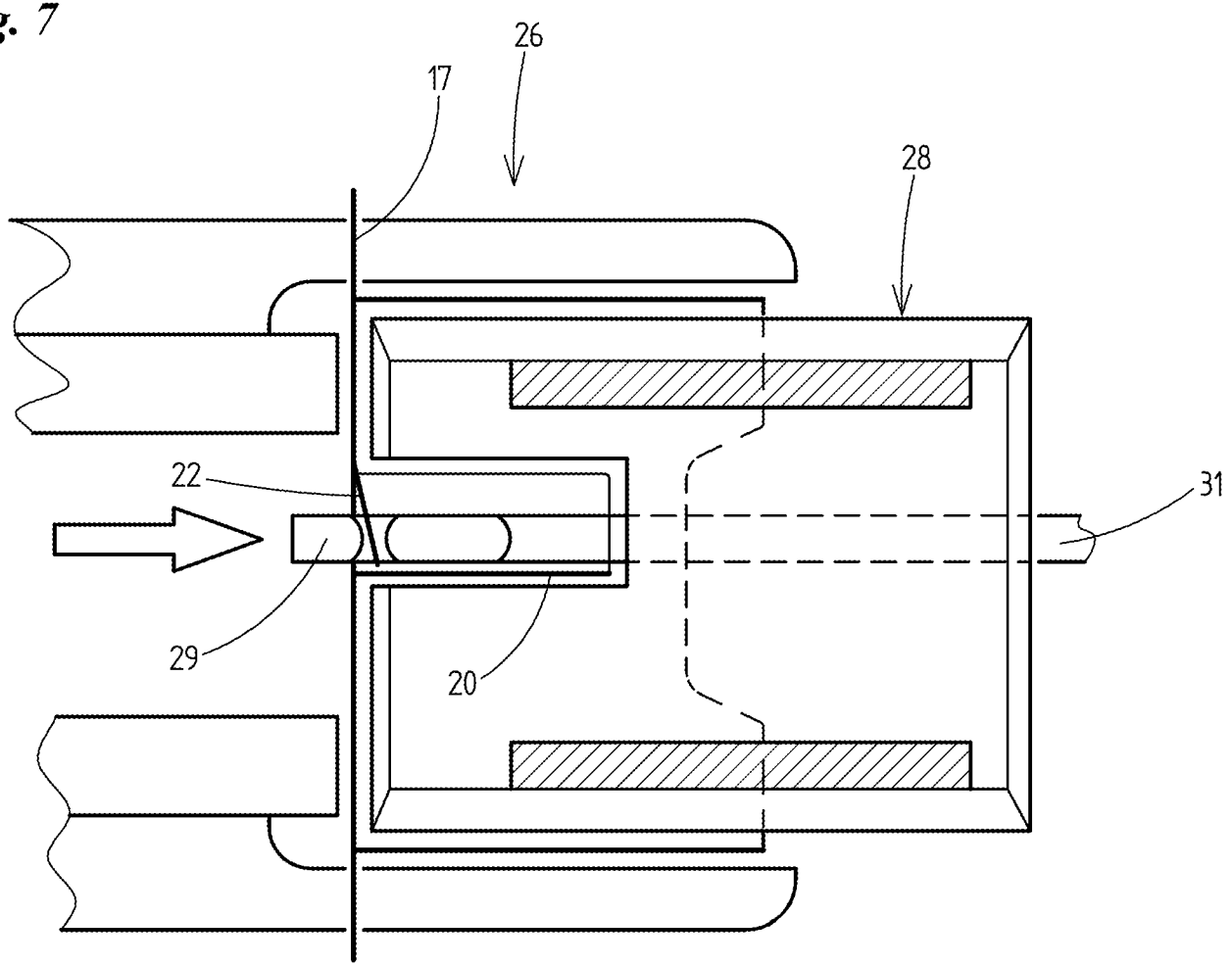
FIG. 7 shows a horizontal section along the section line VII-VII in FIG. 6.
Figure 8:
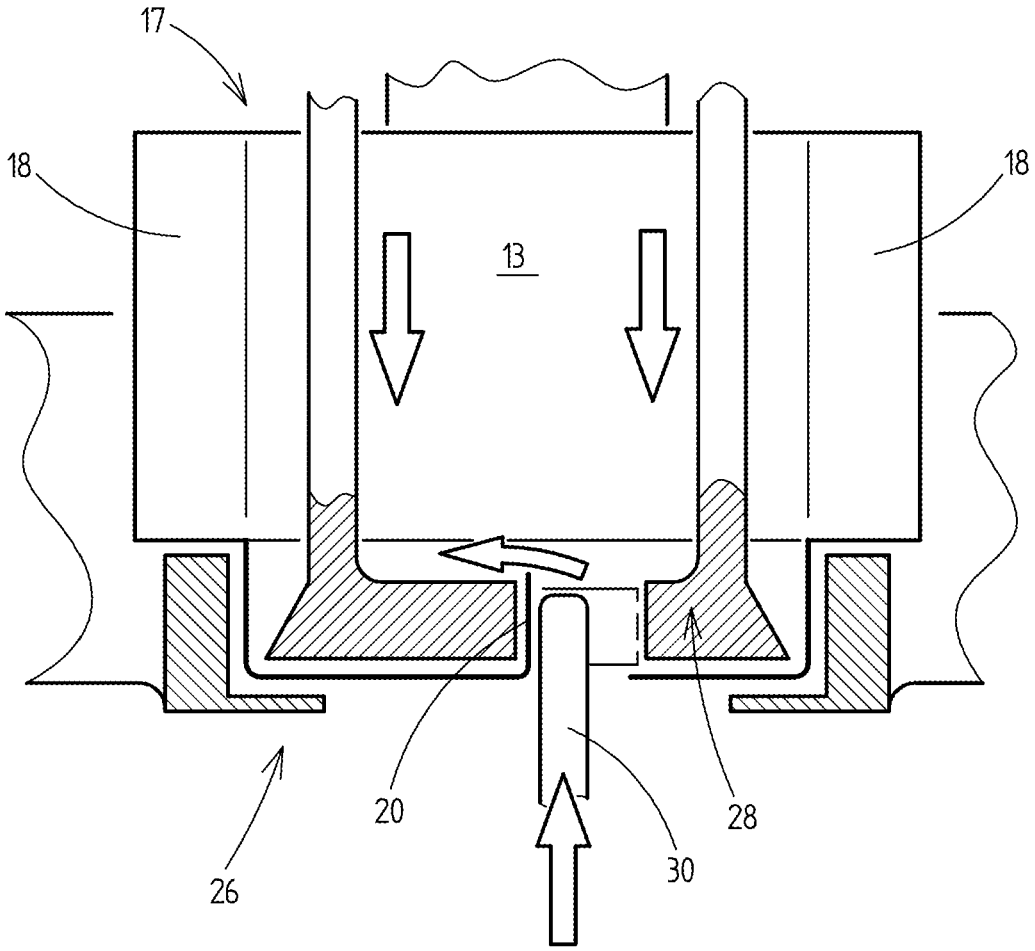
FIG. 8 shows a vertical section along the section line VIII-VIII in FIG. 6.

FIGS. 6, 7, and 8 show the mutually adapted movement of the ram 28 and of the folding members 29, 30. The ram 28 pushes the blank 27 into the pocket 26, and the folding members 29, 30 fold the separator 20 and the locking tab 22 while the blank 17 is fixed in the pocket 26 by the ram 28.

The folding member 30 here penetrates the pocket 26 from below, and the folding member 29 penetrates the region of a rear side of the pocket 26.

The movements of the ram 28 and of the folding members 29, 30 can be superimposed, or the folding members 29, 30 can perform their part of the work once the ram 28 has rammed the blank 17 into the pocket 26.

The movement of the folding members 29, 30 can also take place successively or in a superimposed manner. The separator 20 or the locking tab 22 can first be erected, and thereafter the respective other element. The elasticity of the packaging material permits the separator 20 and the locking tab 22 to be moved past one another. The sequence of folding can be achieved by a corresponding angular position of the lever 31 and the relative position of the folding members 29, 30 resulting therefrom.

Should a locking protrusion 23 be provided instead of the locking tab 22, the folding member 29 can of course be dispensed with. The separator 20 by way of the folding member 30 is erected to the extent that the locking protrusion 23 enters the clearance 24 and secures the position of the separator 20.

Should folding of the separator 20 and optionally of the locking tab 22 be performed in one of the following stations of the folding turret 25, the folding members 29, 30 can be accordingly positioned. Means customary in the industry for holding the blank 17 during folding may optionally be provided.

2.2 Feeding the Groups of Products:

FIGS. 9 to 18 pertain to measures in the context of feeding the groups 10 of products to the pocket 26, or to the blank offered up and partially folded in the latter, respectively. Here too, aligning or fixing, respectively, of the separator 20 takes place independently of the locking tab 22 or the locking protrusion 23. To this end, various aligning members that will be described hereunder may be used. However, the fundamental construction of the device in this region is to be discussed first.

The two groups 10 of products are fed in two webs, or next to one another, respectively, specifically by means of an insertion slide 33 in combination with a platform 34 that is able to be moved in a reciprocating manner. The construction of the insertion slide 33 and of the platform 34, and the operating mode thereof, are known from EP 0 9 94 029 A1 by the applicant, for example, reference to which is made for the purpose of full disclosure.

The groups 10 of products are gripped on the rear side by the common insertion slide 33, and in the transport direction over the platform 34 and by a stationary throat 35 on the circumference of the folding turret 25 pushed into a pocket 26, or into the blank 17 offered up and partially folded in the latter, respectively. A centric separating wall 40 which ensures that the two groups 10 of products are kept at a mutual lateral spacing also in the throat 35 in order to be in each case pushed adjacent to one another toward the erected separator 20 is provided in the throat 35.

In order to avoid any potential collision between the groups 10 of products and the already erected separator 20, various aligning members which will now be described in detail are proposed for the separator:

2.2.1 Variant with a "Centering Wheel"

In the solution shown in FIGS. 9 to 14 and FIG. 18, a rotating centering wheel 36 is provided as an aligning member for the separator 20. The centering wheel 36 is disposed on the folding turret 25 so as to be above the pockets 26 and is driven so as to rotate about a horizontal axis. The centering wheel 36 on the circumference has two walls 37 which by way of a corresponding profile of the walls 37 are specified for first aligning the separator 20 between the walls 37 during the rotation of the centering wheel 36, and for then holding the separator 20 in the aligned position between the walls 37 during the further rotation of the centering wheel 36, while the groups 10 of products are being inserted.

Figure 10:
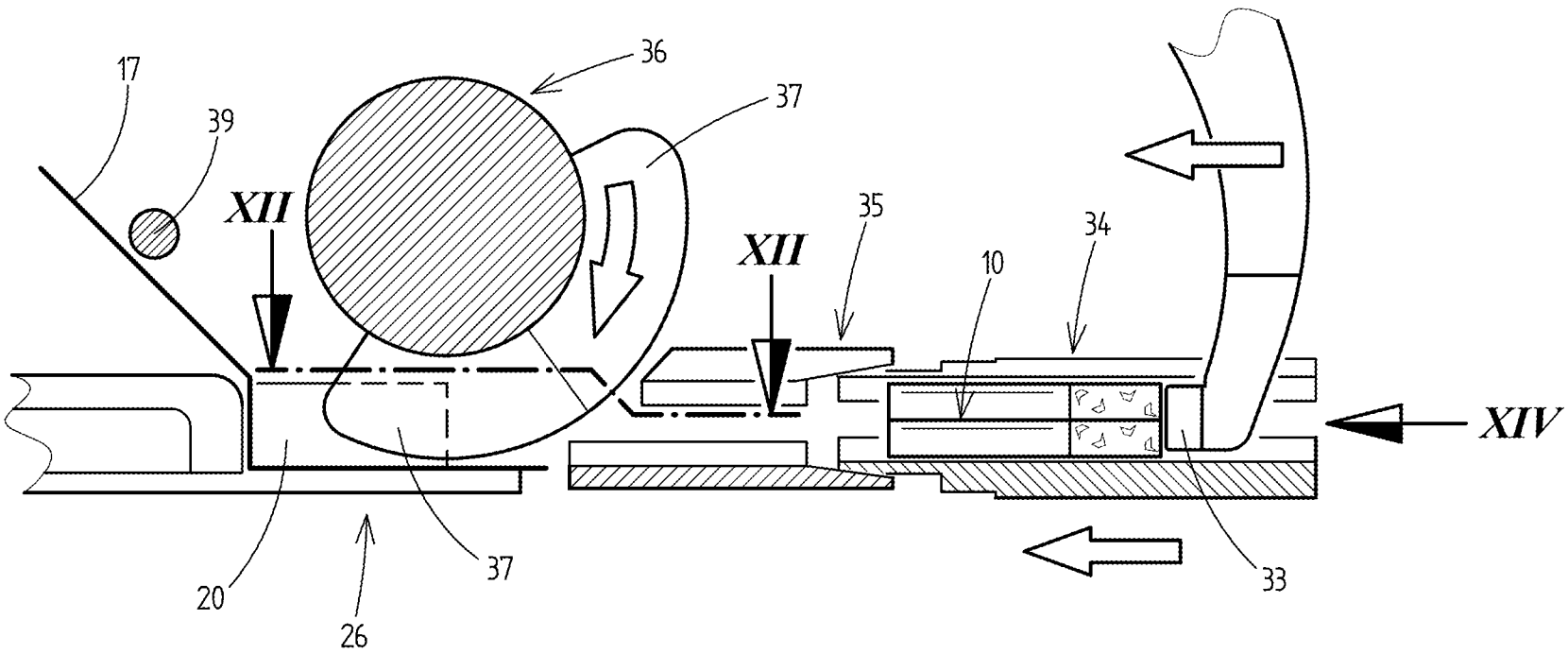
Figure 12:
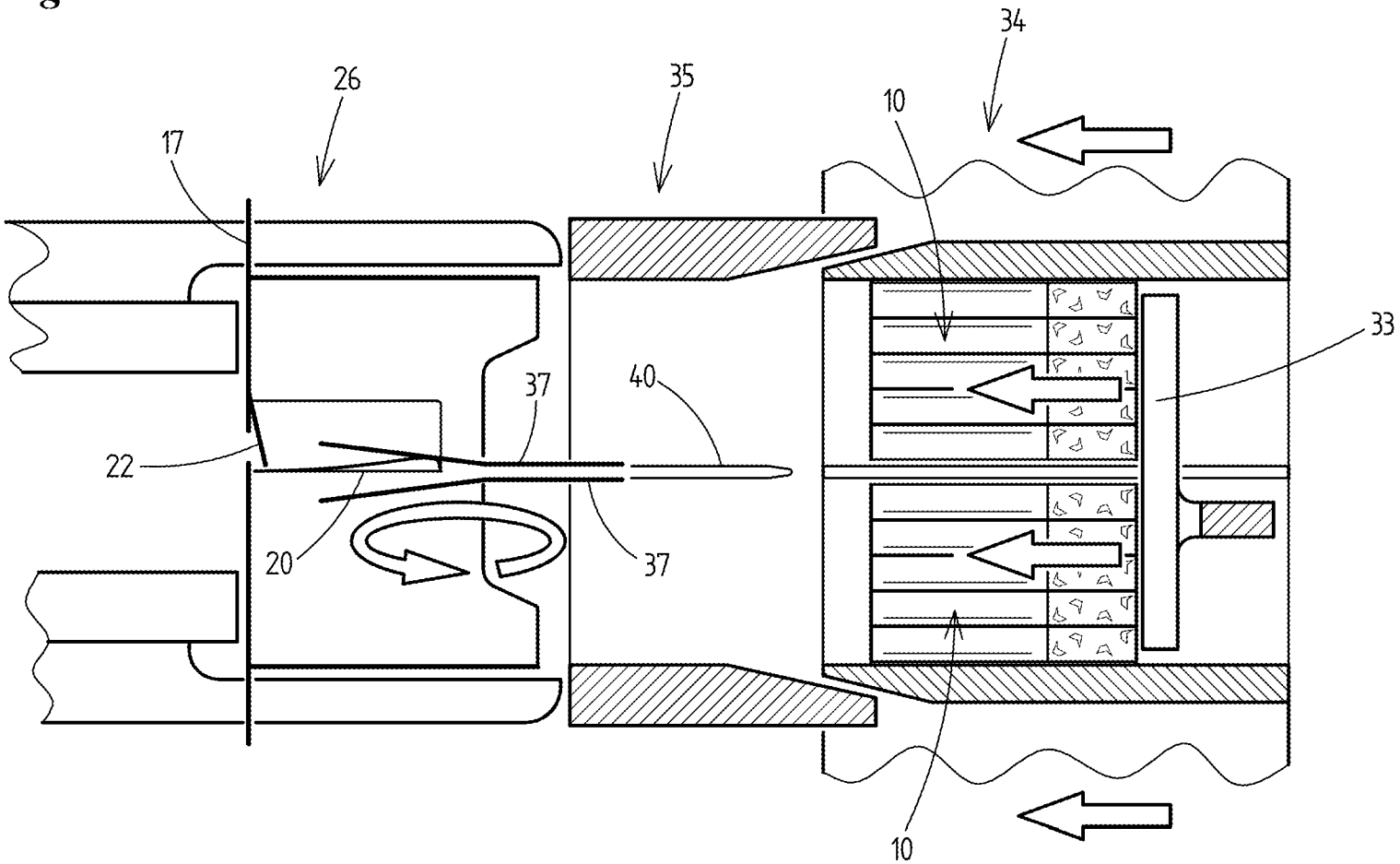
FIG. 12 shows a horizontal section along the section line XII-XII in FIG. 10.
Figure 18:
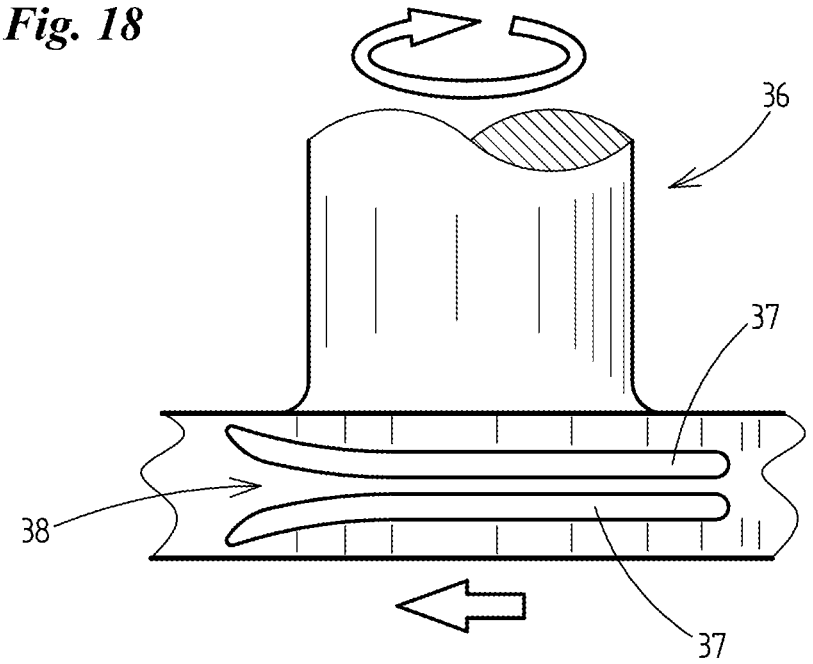
FIG. 18 shows a partially developed view of the aligning member in FIG. 9, corresponding to the arrow XVIII.

FIG. 18 shows the profile of the walls 37 having a funnel-shaped inlet region 38 and a parallel profile of the walls 37 adjoining the latter. The funnel-shaped inlet region 38 serves for receiving the separator 20 during the rotation and for guiding said separator 20 to the aligned position (FIGS. 10 and 12).

Figure 11:
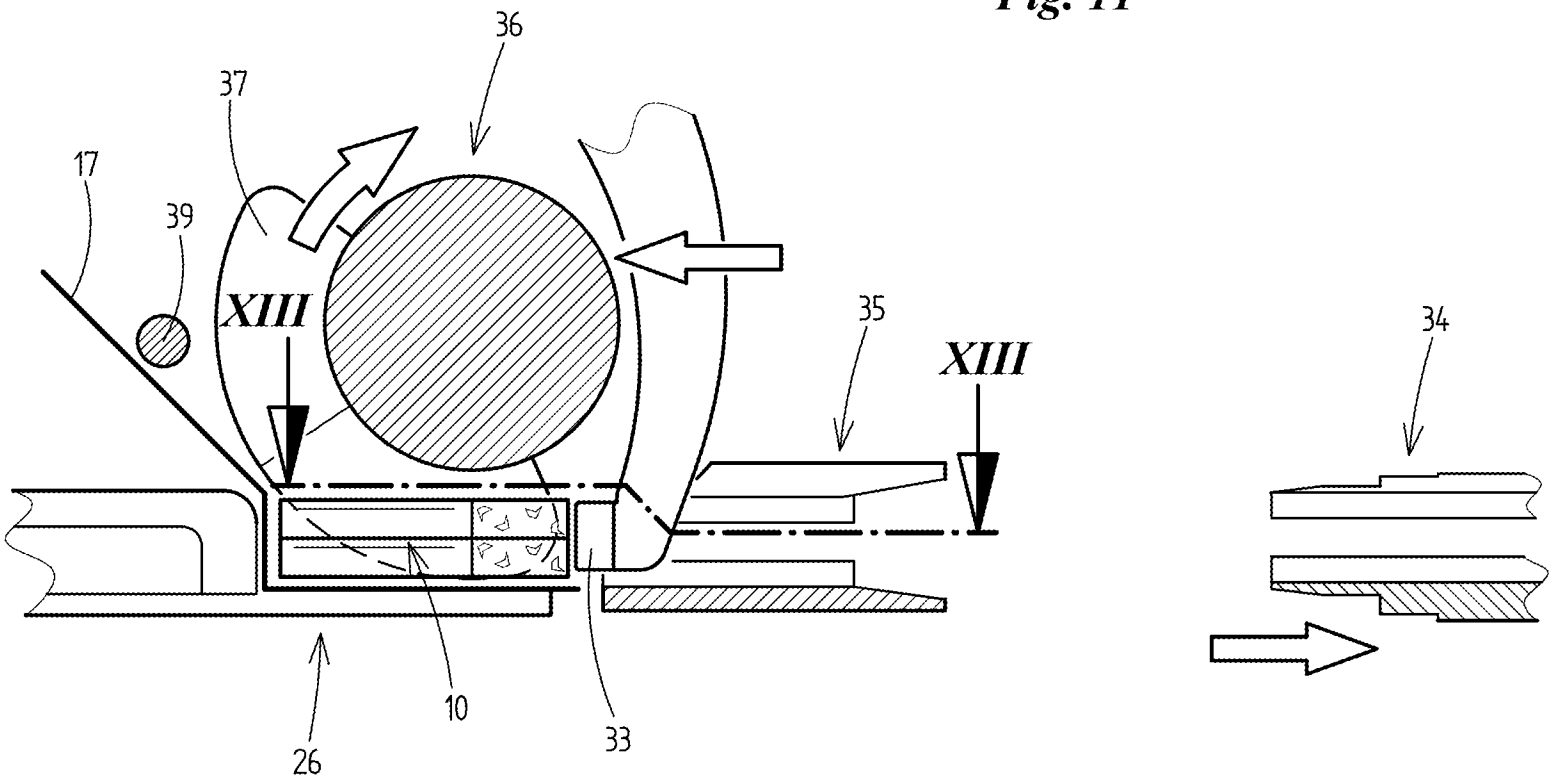
Figure 13:
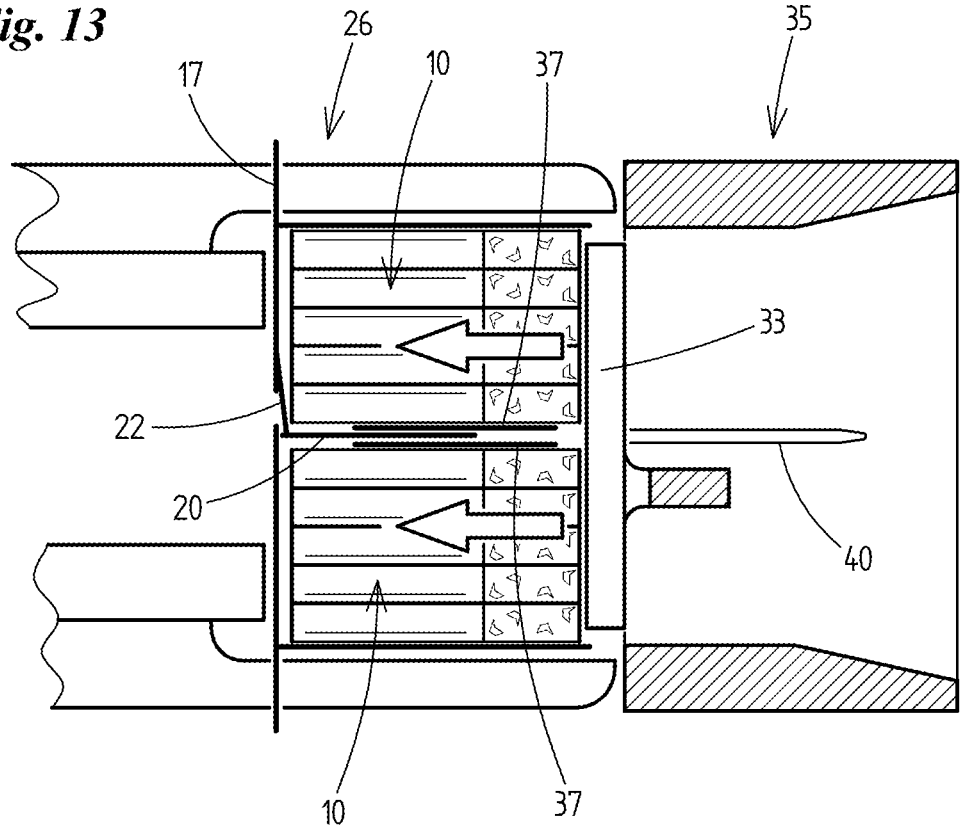
FIG. 13 shows a horizontal section along the section line XIII-XIII in FIG. 11.
Figure 14:
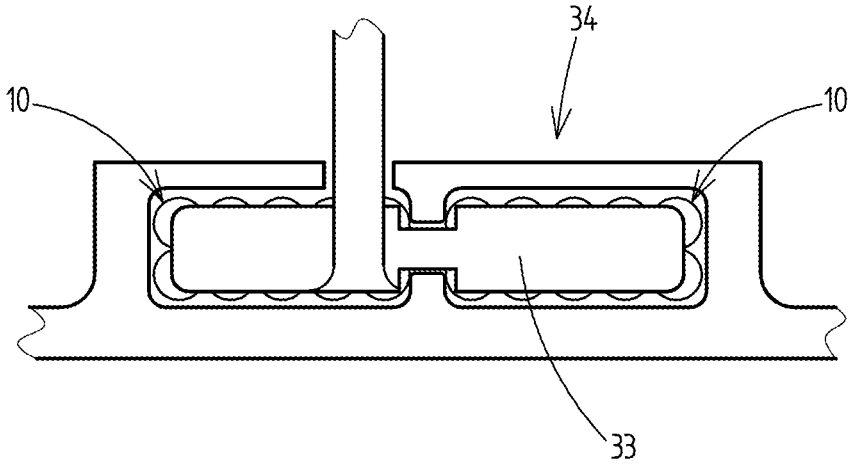
FIG. 14 shows a view corresponding to the arrow XIV in FIG. 10.
Figure 15:
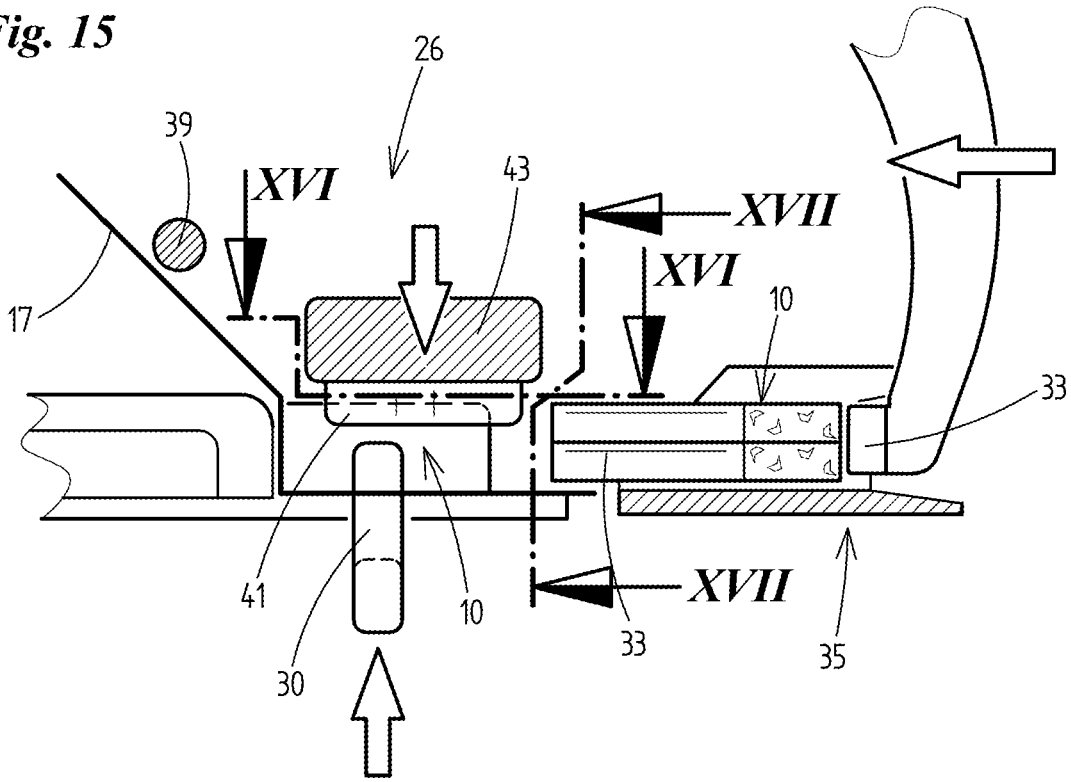
FIG. 15 shows a second exemplary embodiment of an aligning member in an illustration corresponding to that of FIG. 9.
Figure 16:
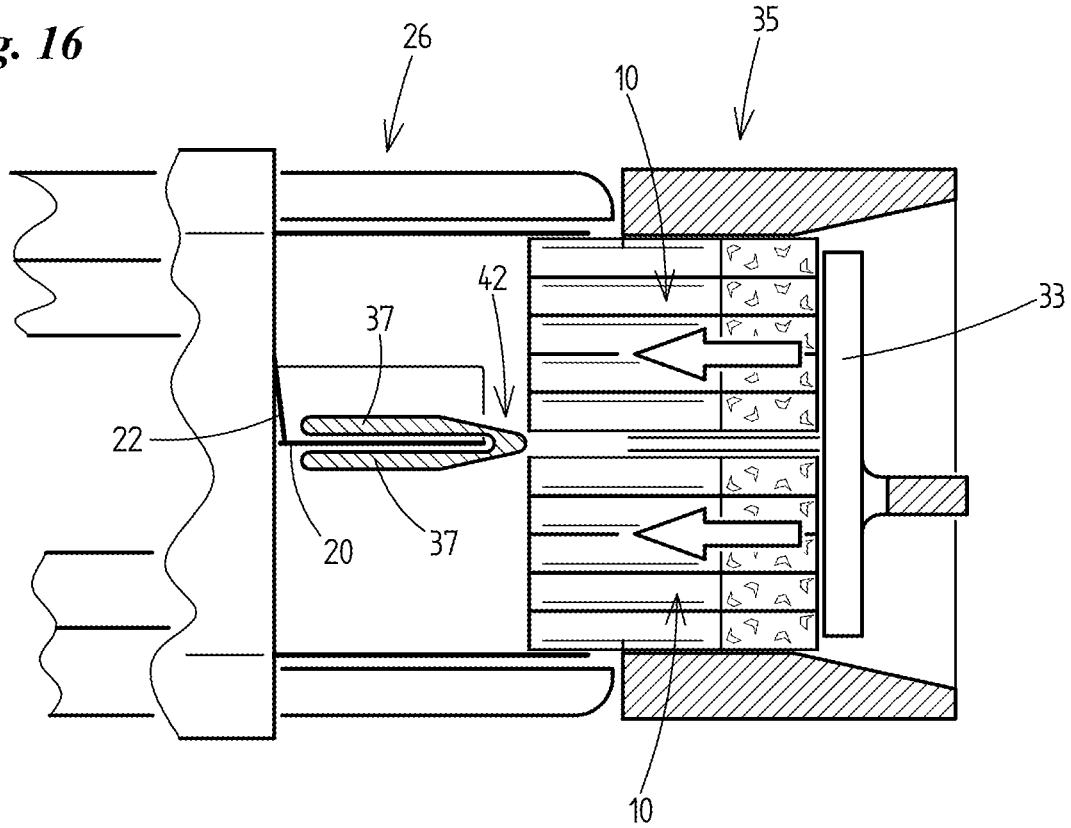
FIG. 16 shows a horizontal section along the section line XVI-XVI in FIG. 15.
Figure 17:
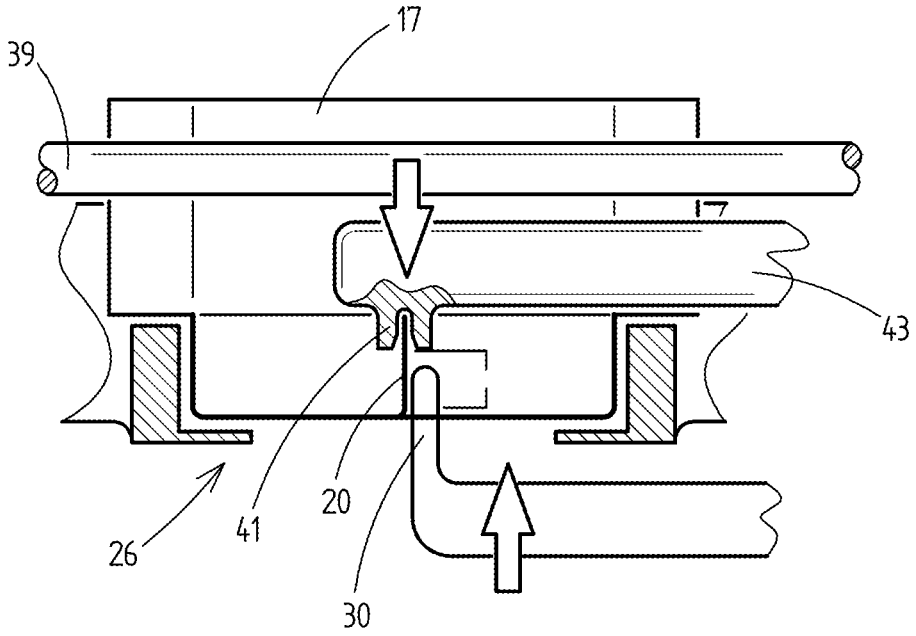
FIG. 17 shows a vertical section along the section line XVII-XVII in FIG. 15.

The spacing of the walls 37 in the adjoining parallel region is sized such that the separator 20 is held in the aligned position while the groups 10 of products are pushed past the separator 20 on both sides and into the pocket 26 (FIGS. 11 and 13).

Figure 9:
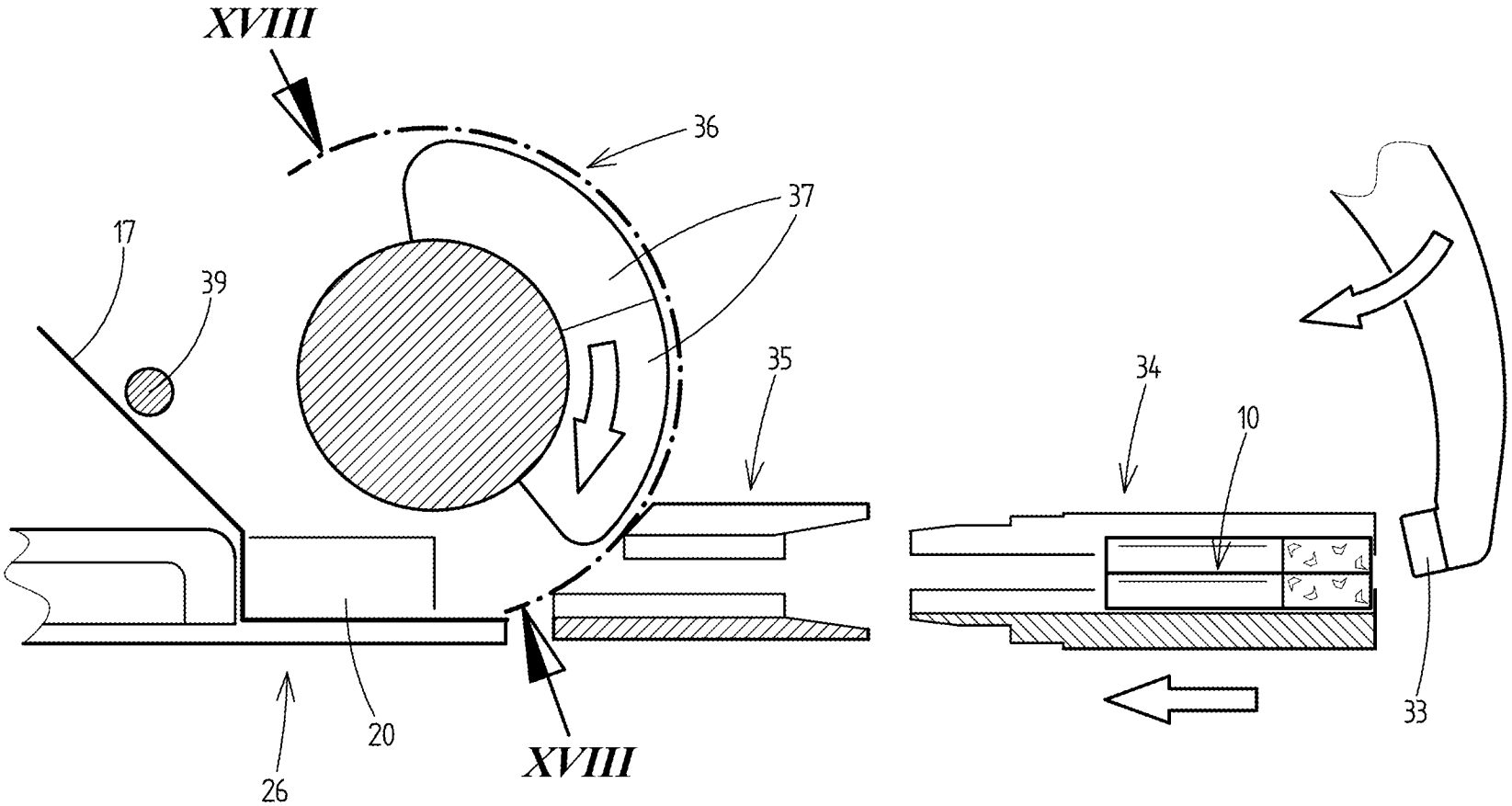
FIGS. 9 to 11 show a vertical section along the section line IX-IX in FIG. 5 in successive phases of the process, having a first exemplary embodiment of an aligning member.

The walls 37 extend only across part of the circumference of the centering wheel 36 so that a collision with the folding turret 25, or the pockets 26, respectively, does not arise during the rotation of the folding turret 25 (FIG. 9). That part of the blank 17 that protrudes from the pocket 26 is guided over a turnout 39.

2.2.2 Variant with a "Separator Holder"

A separator holder 41 can also be used as an alternative to the centering wheel 36. Like the centering wheel 36, the separator holder 41 possesses two walls 37, the separator 20 being held therebetween. The separator holder 41 furthermore possesses an entry region 42 in which the walls 37 converge, thus directing the two groups 10 of products past the separator 20 on both sides.

The separator holder 41 is placed onto the separator 20 from above so that the walls 37 hold the separator 20 on both sides. To this end, the separator 20 can be disposed on a holder 43.

3. Final Comments

The fixing or aligning, respectively, of the separators 20 in the context of this application takes place substantially with consideration of the following:

On the one hand, securing the position of the separator 20 in the finished packet is achieved by way of the locking tab 22, or the locking protrusion 23, respectively. This securing of the position takes effect as soon as the first products have been retrieved from the packet and the products standing upright have the tendency to tilt. The width of the respective receptacle space is reduced by the separator 20, and tilting of the products is thus avoided.

Of course, this securing of the position moreover ensures a preliminary alignment of the separators 20 for the following infeed of the groups 10 of products. Because the groups 10 pretty precisely fill the respective receptacle space, there is little leeway in terms of the alignment of the separators 20 so as to avoid any collision with the groups 10 during feeding. With the aid of the separators 20 being secured by the locking tab 22, or the locking protrusion 23, respectively, the separators 20 are already situated rather close to the position required for feeding the groups 10. The gripping of the separators 20 by the aligning member and the adjusting of said separators 20 to the exact position is simplified in this way.

The individual steps in the method sequence can in principle take place successively or else in a (partially or completely) superimposed manner. However, in order to avoid any collision, the folding members 29, 30 must be removed from the pocket 26 before the groups 10 of products can be inserted completely into the pocket 26. On the other hand, the separator 20 must be aligned before the groups 10 of products reach the region on both sides of the separator 20 in order to avoid a collision at this point. Once the two groups 10 of products have reached the region on both sides of the separator 20 and sufficiently stabilized the separator 20, these aligning members are basically no longer required and can be retracted from the separator 20.

4. Alternative Packets

Figure 19:
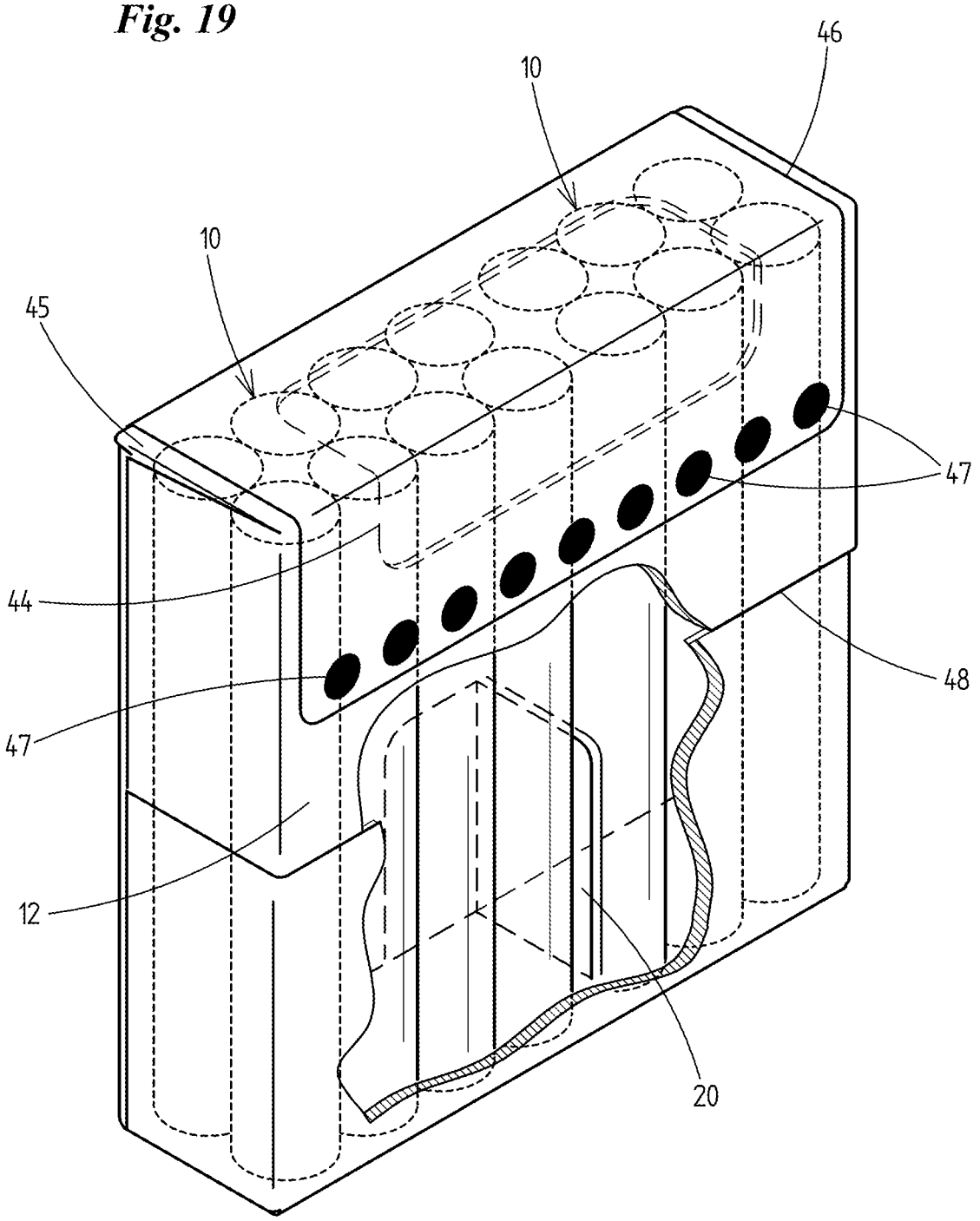
FIG. 19 shows an alternative packet in an illustration corresponding to that of FIG. 1.

FIG. 19 shows a potential alternative packet for cigarette industry products. As opposed to the exemplary embodiment described at the outset, the upper side of the tray 11 is not open, but a retrieval opening 44 which extends continuously across part of an end wall 45 and the front wall 12 is provided. Accordingly, the clearance 16 of the first exemplary embodiment is dispensed with. The retrieval opening 44 is closed by a seal label 46. Glue spots 47 serve for connecting the seal label 46 to the inside of a lid of a hinge-lid outer packet, the latter potentially being disposed as an inner packet in the packet.

In this case, the products are conventional cigarettes which have a larger longitudinal extent than the heat-not-burn products. In this case, the groups 10 are also not of identical size but are composed of eight products, on the one hand, and six products, on the other hand. A further particularity lies in that the front wall 12 is formed from two walls which bear on one another in the region of a joint 48.

As a further point of differentiation it is finally provided that the separator 20 is formed in the rear wall 13.

The description above overall relates to packets having two groups 10 of products. However, variants with a larger number of groups 10, for example three or four, are also within the scope of the invention. To this extent, the invention is not limited to a number of two groups 10. In packets having a larger number of groups 10, the number of separators 20 can also be accordingly adapted such that each group 10 is disposed in a dedicated receptacle space. Alternatively, it can also be provided in such a case that a plurality of groups 10 can be disposed in one receptacle space. In principle, it is also conceivable that a separator 20 as described is formed by part of the tray, and that another separator is formed by part of another component part of the packet, for example by part of the collar or an additional, in particular separate, element.

It is understood that the invention is also not limited to the two variants of the packets shown. Various modifications are possible within the scope of the invention.

LIST OF REFERENCE SIGNS

10 Group
11 Tray
12 Front wall
13 Rear wall
14 Narrow side wall
15 Base wall
16 Clearance
17 Blank
18 Lateral tabs
19 Base corner tabs
20 Separator
21 Punched cut
22 Locking tab
23 Locking protrusion
24 Clearance
25 Folding turret
26 Pocket
27 Magazine
28 Ram
29 Folding member (locking tab)
30 Folding member (separator)
31 Lever
32 Guide rail
33 Insertion slide
34 Platform
35 Throat
36 Centering wheel
37 Wall
38 Inlet region
39 Turnout
40 Separating wall (throat)
41 Separator holder
42 Entry region
43 Holder
44 Retrieval opening
45 End wall
46 Seal label
47 Glue spot
48 Joint

The invention claimed is:

1. A packet for cigarette industry products, comprising:

a tray (11) for receiving at least one group (10) of products, wherein the tray (11) is constructed to receive at least two groups (10) of products; and at least one separator (20) for delimiting two receptacle spaces for least one group (10) of products, the at least one separator (20) being disposed in an interior of the tray (11), and wherein the at least one separator (20) is formed from a wall of the tray (11), wherein the tray (11) has two large-area, mutually opposite walls, specifically an upright front wall (12) and a corresponding rear wall (13), wherein the tray (11) has two upright narrow side walls (14) which are mutually opposite and connect the front wall (12) and the rear wall (13) to one another, and wherein the tray (11) has a lower base wall (15) which connects the front wall (12), the rear wall (13) and the side walls (14) to one another, and wherein the at least one separator (20) is disposed in at least one of the large-area walls (12, 13), and wherein when the at least one separator (20) is in the position that delimits the receptacle spaces, the at least one separator (20) is secured on the base wall (15) of the tray (11).

2. The packet as claimed in claim 1, wherein the at least one separator (20) is a folding tab which is formed by a punched cut in the material of a wall of the tray (11) and for delimiting the receptacle spaces is movable into the interior of the tray (11) by being pivoted in relation to the respective wall of the tray (11).

3. The packet as claimed in claim 1, wherein when the at least one separator (20) is in the position that delimits the receptacle spaces, the at least one separator (20) is securable by engaging by way of a locking protrusion (23) configured on the separator (20) in a clearance formed in the base wall (15) of the tray (11).

4. The packet as claimed in claim 1, wherein when the at least one separator (20) is in the position that delimits the receptacle spaces, the at least one separator (20) is securable by a locking tab (22) which is formed in the base wall (15) of the tray (11) and supports the separator (20).

5. The packet as claimed in claim 4, wherein the locking tab (22) is formed by a punched cut in the material of the base wall (15) of the tray (11), and, by pivoting in relation to the base wall (15), the locking tab (22) is movable to a position unilaterally supporting the at least one separator (20).

6. The packet as claimed in claim 1, wherein at least some groups (10) of products, or the products, respectively, are disposed in the tray (11) so as to bear directly on walls of the tray (11).

7. The packet as claimed in claim 1, wherein the tray (11) is a component part of a sealed pack, and conjointly with the groups (10) of products is surrounded by a sealed casing of packaging material.

8. A method for producing packets for cigarette industry products, comprising the steps of:

introducing a blank (17) of packaging material for a tray (11) of the packet into a pocket (26) of a folding turret (25) that at least partially folds the blank (17);

thereafter feeding a group (10) of products into the partially folded blank (17); and while the blank (17) is being transported onward on the folding turret (25), folding the blank (17) about the group (10) of products, wherein the blank (17) has at least one separator (20) which serves for delimiting two receptacle spaces in an interior of the tray (11) for at least one group (10) of products, and the at least one separator (20) is formed by part of a wall of the blank (17), and wherein the separator (20) is provided by a folding member to a position delimiting the receptacle spaces before the groups (10) of product are fed into the blank (17), and wherein when the at least one separator (20) is in the position delimiting the receptacle spaces, the at least one separator (20) is held by an aligning member until the two groups (10) of products on both sides of the separator (20) are fed into the pocket (26) and the blank (17) situated in the pocket (26).

9. The method as claimed in claim 8, wherein when the at least one separator (20) is in the position delimiting the receptacle spaces, the at least one separator (20) is secured by a locking tab (22) of the blank (17), and wherein the locking tab (22) by a folding member is moved to a position securing the separator (20).

10. The method as claimed in claim 9, wherein the at least one separator (20) and the locking tab (22) are movable by a common folding member to the position delimiting the receptacle spaces, or to the position securing the separator (20).

11. The method as claimed in claim 10, wherein first the separator (20) and then the locking tab (22) are folded, or wherein first the locking tab (22) and then the separator (20) are folded, by the common folding member or separate folding members.

12. The method as claimed in claim 9, wherein the at least one separator (20) and/or the locking tab (22) are/is folded when introducing the blank (17) into the pocket (26), or wherein the at least one separator (20) and/or the locking tab (22) are/is folded while the blank (17) later is being transported on the folding turret (25), in a station for feeding the groups (10) of products.

13. The method as claimed in claim 8, wherein a rotating centering wheel (36) serves as the aligning member for the at least one separator (20), wherein the centering wheel (36) has two walls (37) and as a result of a corresponding profile of the walls (37) is specified for first aligning the at least one separator (20) between the walls (37) during the rotation of the centering wheel (36), and for then holding said the at least one separator (20) in an aligned position between the walls (37) during the rotation of the centering wheel (36).

14. The method as claimed in claim 8, wherein a separator holder (41) serves as the aligning member for the at least one separator (20), said separator holder (41) by way of walls (37) gripping the separator (20) peripherally from above, and holding the separator (20) while the groups (10) of products are being fed, said separator holder (41) being retracted from the separator (20) after the groups (10) of products have been fed.

15. A device for producing packets for cigarette industry products, the device comprising a folding turret (25), a folding member, and an aligning member, wherein the device is constructed for receiving a blank (17) of packaging material for a tray (11) of the packet in a pocket (26) of the folding turret (25), for at least partially folding the blank (17), and for thereafter introducing a group (10) of products into the partially folded blank (17), and for then folding the blank (17), while being transported onward on the folding turret (25), about the group (10) of products, wherein the blank (17) has at least one separator (20) which serves for delimiting two receptacle spaces in the interior of the tray (11) for at least one group (10) of products and is formed by part of a wall of the blank (17), and wherein the device, by way of the folding member, is constructed for pivoting the at least one separator (20) to a position delimiting the receptacle spaces before the groups (10) of products are fed, and wherein the aligning member is constructed for holding the at least one separator (20) in the position delimiting the receptacle spaces until the two groups (10) of products on both sides of the separator (20) have been fed into the pocket (26) and the blank (17) situated in the pocket (26).

16. The device as claimed in claim 15, wherein when the at least one separator (20) is in the position delimiting the receptacle spaces, the at least one separator (20) is secured by a locking tab (22) of the blank (17), and the folding member is constructed for moving the locking tab (22) to a position securing the separator (20).

17. The device as claimed in claim 16, wherein the at least one separator (20) and the locking tab (22) are movable by a common folding member to the position delimiting the receptacle spaces, or to the position securing the separator (20), respectively.

18. The device as claimed in claim 15, further comprising a rotating centering wheel (36) that is provided as the aligning member for the at least one separator (20), wherein the centering wheel (36) has two walls (37) and as a result of a corresponding profile of the walls (37) is constructed for first aligning the separator (20) between the walls (37) during the rotation of the centering wheel (36), and for then holding said separator (20) in the aligned position between the walls (37) during the rotation of the centering wheel (36).

19. The device as claimed in claim 18, wherein the centering wheel (36) has two substantially parallel walls (37), the separator (20) being held therebetween, and wherein the centering wheel (36) has an inlet region (38) which for feeding the at least one separator (20) between the walls (37) widens in the shape of a funnel.

20. The method as claimed in claim 15, further comprising a separator holder (41) provided as the aligning member for the at least one separator (20), said separator holder (41) by way of walls (37) being constructed for gripping the separator (20) peripherally from above, and for holding the separator (20) while the groups (10) of products are being fed, said separator holder (41) being retractable from the separator (20) after the groups (10) of products have been fed.

* * * * *